United States Patent [19]

Bartsch et al.

[11] Patent Number: 4,647,358

[45] Date of Patent: Mar. 3, 1987

[54] CURRENT-FEEDING CATHODE-MOUNTING DEVICE

[75] Inventors: Adalbert Bartsch, Marxen; Gerhard Berndt, Seevetal, both of Fed. Rep. of Germany

[73] Assignee: Norddeutsche Affinerie AG, Hamburg, Fed. Rep. of Germany

[21] Appl. No.: 762,603

[22] Filed: Aug. 5, 1985

[30] Foreign Application Priority Data

Sep. 19, 1984 [DE] Fed. Rep. of Germany ..... 3434278

[51] Int. Cl.[4] ..... C25B 11/00

[52] U.S. Cl. ..... 204/286; 204/288

[58] Field of Search ..... 204/280, 286, 288, 290 R

[56] References Cited

U.S. PATENT DOCUMENTS

| | | | |
|---|---|---|---|
| 2,434,731 | 1/1948 | Eltz | 204/286 |
| 3,515,661 | 6/1970 | Coulter et al. | 204/286 X |
| 4,033,849 | 7/1977 | Pohto et al. | 204/286 |
| 4,121,994 | 10/1978 | Crippen et al. | 204/286 |
| 4,184,074 | 1/1980 | Perry | 204/288 X |
| 4,319,977 | 3/1982 | Wortley | 204/286 X |
| 4,373,654 | 2/1983 | Prengaman et al. | 204/286 X |
| 4,380,493 | 4/1983 | Wortley et al. | 204/286 X |
| 4,391,695 | 7/1983 | Koziol et al. | 204/286 |

FOREIGN PATENT DOCUMENTS 2434214 1/1976 Fed. Rep. of Germany .

*Primary Examiner*—Howard S. Williams
*Assistant Examiner*—Nam X. Nguyen
*Attorney, Agent, or Firm*—Sprung, Horn, Kramer & Woods

[57] ABSTRACT

A current-feeding cathode-mounting device comprises a metal-sheathed carrying rail of copper and a permanent cathode plate consisting of the same material as the sheath and joined by welding at least along part of a longitudinal edge and wherein at least an end portion of the rail is unsheathed at least along part of its extent. In order to increase the creep strength and durability and to ensure a low-resistance contact, the carrying rail consists of a hollow copper section, the sheath consists of special steel, the sheath is joined to the carrying rail by a diffusion-preventing non-porous weld, and the permanent cathode of special steel is joined to the sheath by an interrupted seal weld. The carrying rail consists suitably of a copper tube. In accordance with a further feature the copper tube provided with a special steel sheath has been deformed to constitute a composite having an elliptical or oval cross-section or a cross-section having two parallel sides, and the major axis of said cross-section lies in the plane of the cathode plate.

4 Claims, 7 Drawing Figures

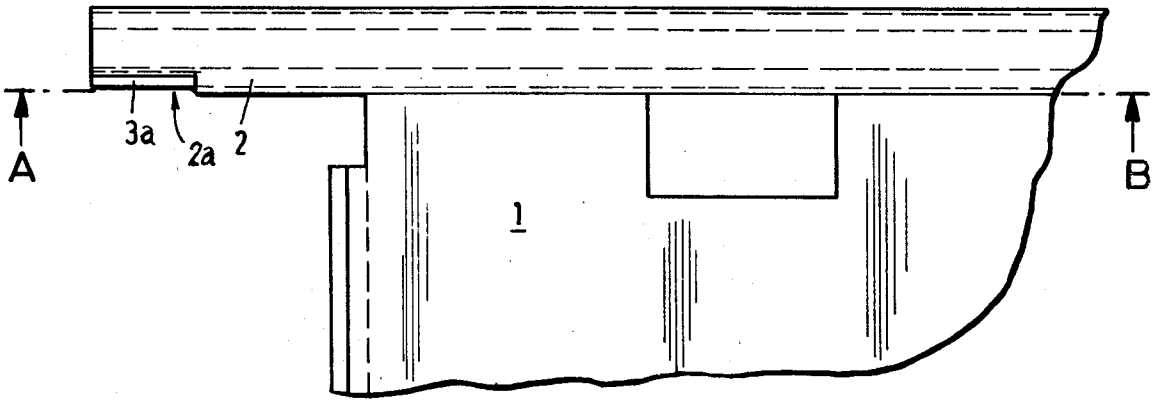
Fig. 1
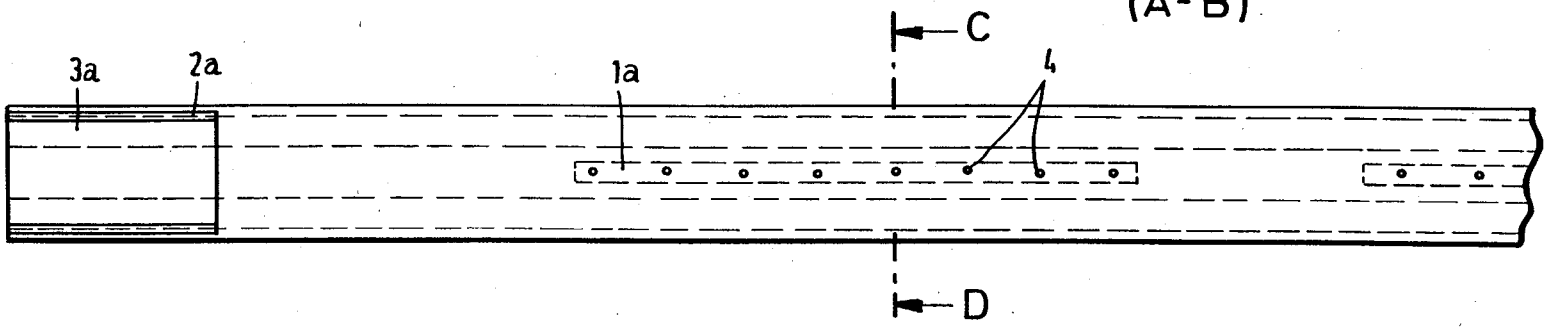
Fig. 2 (A-B)

(C-D)

CURRENT-FEEDING CATHODE-MOUNTING DEVICE

BACKGROUND OF THE INVENTION

This invention relates to a current-feeding cathode-mounting device, particularly for cathodes for use in refining copper.

Various designs for cathodes for the electrolytic refining of copper are known. Said designs differ as regards the materials or material combinations selected in order to ensure a high electrical conductivity so as to minimize energy losses, and a high mechanical stability so as to reduce repair costs and to minimize production and quality losses, and as regards resistance to corrosion. Owing to its high electrical conductivity, copper has generally been employed as a material for the carrying rails to which, e.g., permanent cathode plates are secured. The carrying rails rest at their ends on busbars, which extend on opposite sides of an electrolytic cell. But copper has disadvantages in that it has only a relatively low strength with regard to damage by deformation during operation and has only a moderate resistance to corrosion, e.g., by the copper-refining electrolyte. In order to improve the resistance to corrosion, the carriers of copper used, e.g., in electrolytic winning processes, have been protected entirely by a sheet metal sheath, which extends as far as to the contact point (bearing point on busbar), and which for reasons of consistency must be joined by a homogeneous soldered joint so that the process is generally uneconomical for electrolytic refining processes.

Laid-open German Application No. 24 34 214 discloses a hanger rail, e.g., of copper, for permanent cathodes, that rail being sheathed with a valve metal by co-extrusion. The sheath metal consists particularly of titanium. The titanium sheath has been removed at the ends of the carrying rail adjacent to the points where it contacts the busbar. A permanent cathode plate consisting of titanium is joined along one edge to the carrying rail by spot welding. Disadvantages are also involved in the use of continuous titanium cathodes of the known type. The process of manufacturing the titanium-sheathed solid copper sections by co-extrusion is highly expensive so that such profiles are used only in special cases and the number of cathodes is usually not very high. Besides, the plate surface which is effective in the process is appreciably passivated by oxidation.

Whereas it would be desirable to combine a titanium-sheathed carrying rail of copper with a cathode plate of corrosion-resisting special steel, that combination cannot be adopted because the materials cannot be joined by welding For this reason Laid-open German Application No. 30 03 927 discloses for use in the electrolytic refining of copper, a hanger rail of stainless steel together with a permanent cathode, which consists also of stainless steel and has been joined by welding. In the known device the hanger rail is provided with a copper covering and a copper covering is also provided adjacent to the point where the cathode plate is welded. It has been found that electro-deposited copper coverings are not satisfactory. The thickness of the required copper covering is highly in excess of the thickness in which copper can generally be electro-deposited (in the micrometer range). The covering must have a thickness of 1.3 to 2.5 mm if appreciable power losses due to voltage drops are to be eliminated and the removal of material by corrosion is to be allowed for. For this reason the copper covering must be applied in expensive special plants, which perform the operations of sand-blasting, cleaning, etching, nickel-plating and copper-plating.

A wide use of the known device is opposed by the technical difficulties and by the high capital requirement for the manufacture of the sheathed solid sections of the carrying rail by coextrusion.

SUMMARY OF THE INVENTION

It is an object of the invention to avoid the disadvantages, particularly the above-mentioned disadvantages, of the known cathodes used for an electrolytic refining of copper, and to provide a mounting device which is provided with a permanent cathode and can be made in a simple manner and at low cost and has a high creep strength and durability and a low contact resistance.

This object is accomplished in that a current-feeding cathode-mounting device of the kind described first hereinbefore comprising a metal-sheathed carrying rail of copper and a permanent cathode plate consisting of the same material as the sheath and joined by welding at least along part of a longitudinal edge, wherein at least and end portion of the rail is unsheathed at least along part of its extent, is so designed in accordance with the invention that the carrying rail consists of a hollow copper section, the sheath consists of special steel, the sheath is joined to the carrying rail by a diffusion-preventing non-porous weld, and the permanent cathode of special steel is joined to the sheath by an interrupted seam weld.

In the device in accordance with the invention the excellent electrical conductivity of copper is fully utilized so that the voltage drop in the mounting device is minimized. Besides, a high dimensional stability is ensured even during rough mechanical handling.

The hollow copper section of the device in accordance with the invention suitably consists of a copper tube and generally has a wall thickness of 4 to 6 mm and an outside diameter usually of 30 to 45 mm, in dependence on the required final weight and dimension of the production cathode. A tubular sheath of high-grade steel has been applied and positively joined to the copper tube. This can most simply be effected in that a special steel tube which has an inside diameter that is only slightly larger than the outside diameter of the copper tube is slidably fitted on the latter. It is suitable, however, to use a special steel tube which has a slot or slit throughout its length. The inside diameter of the special steel tube may be as large as or smaller than the outside diameter of the copper tube. That design will result in a very snug fit and in an additional possibility to ensure an improved and uniform flow of current from the current-carrying copper bar to the sheath in that the longitudinal slot is closed by welding, e.g., by weld bead placed into the slot. The longitudinal slot or slit is usually disposed on that side which faces away from the electrolyte. Alternatively, it may be desirable to arrange the longitudinal slot of the sheath so that it faces the electrolyte. In that case at least part of the upper edge of the cathode plate is slidably inserted into the slot and is welded to the copper tube and to the special steel sheath adjacent to the slot.

In a particularly desirable and economical manner the composite can be made by the method used to make tubes having a longitudinal seam weld. In that case the hollow copper section, such as a copper tube, is introduced in the rolling and welding line into the special steel strip from which the tube is usually made. Welding is effected adjacent to the sectional gap remaining between the copper tube and the special steel sheath.

It will be understood that the sheath may alternatively consist of a special steel sheet which has been applied as a snug fit by known methods of non-cutting shaping.

In all cases the sheath is recessed or notched at least at one end of the carrying rail so that the copper material of the hollow section is exposed there and can be contacted with the copper busbar of the electrolytic cell. At the cut portions and at all ends of the composite, the special steel sheath is welded to the hollow copper section by non-porous welds, which prevent a diffusion of gas. The tight seal between the hollow body of copper and the special steel sheath prevents a diffusion of liquid and gas and ensures a satisfactory, defined flow of current through the cross-sections of the seam welds.

In many cases, it will be sufficient to provide a composite carrying rail consisting of a copper tube sheathed with special steel and said carrying rail will have a high mechanical stability and a high electrical conductivity. In order to increase the mechanical stability in the direction of the stresses which arise and in order to improve the electrical conductivity, the composite hollow body in accordance with the invention is deformed by an application of pressure in such a manner that the copper tube provided with a special steel sheath is shaped to form a composite which has a elliptical cross-section or a cross-section having two parallel surfaces and the major axis of said cross-section lies in the plane of the cathode plate. If the mounting device in accordance with the invention has an elliptical or oval shape in cross-section, the desirable point contact will be obtained at the current-feeding ends without a need for a special manufacturing operation and the unconstraining support of the device on the busbar will ensure that the cathode plate will be in a vertical position, which is important for the success of the electrolysis. Besides, space will be saved adjacent to the carrying rail if that shape is selected for the mounting device in accordance with the invention.

The deformed composite is suitably provided with additional contact pressure points, which have been formed, e.g., by blows with a center punch and contribute to a current flow with lower losses. Specifically, rows of center punch marks are provided at the lower generatrix of the section. In that case the rows of center punch marks are restricted in length to the length of the seam welds and are covered by the latter.

A permanent cathode consisting like the sheath of special steel is welded to the sheath on the underside of the mounting device in accordance with the invention. In order to avoid an excessive longitudinal stress and warping of the cathode plate the welded joint consists of a interrupted seam weld. The upper edge of the cathode plate is suitably weld-joined to the underside of the sheath at a plurality of webs.

Materials which are suitable for the cathode plate and for the sheath include special steel, that is, corrosion resisting special steel, e.g. stainless steel, which for the purposes of this application are defined as steels, comprising chromium, nickel, or chromium, nickel and molybdenum, for instance, austenitic chromium-nickel steels composed of 17 to 18% Cr, 10 to 12% Ni, 2 to 2.5% Mo, and stabilized, e.g., with Ti, Nb, Ta, in dependence on the carbon content.

The advantages afforded by the mounting device in accordance with the invention reside in that its manufacture is simple and economical, the entire device has virtually only surfaces of special steel so that it is resistant to corrosion and an effective current flow between the copper section and the special steel sheath is ensured by welded joints and by additional contact points provided by the application of pressure and as rows of center punch marks. The mounting device also ensures that the cathode plate will assume a vertical position in the electrolytic cell.

The invention will be described more in detail and by way of example with reference to the drawings.

BRIEF DESCRIPTION OF THE DRAWINGS

FIG. 1 is a side elevation showing a portion of the mounting device.

FIG. 2 is an enlarged horizontal sectional view taken from underneath on line A–B in FIG. 1 at the lower edge of the carrying rail.

DETAILED DESCRIPTION OF THE INVENTION

In accordance with FIG. 1 the cathode plate 1 is welded to the special steel sheath 2, which encloses the hollow copper section 3. At the end of the carrying rail the copper section 3*a* is exposed to provide a contact point because the sheath has been formed with a recess or notch 2*a*.

FIG. 2 is a sectional view taken on line A–B of FIG. 1 viewed from underneath. Adjacent to the joint between the cathode plate, the position of which is shown in dotted lines 1*a*, and the sheath 2, a row of center punch marks 4 has been provided in order to improve the contact.

Figure 3:
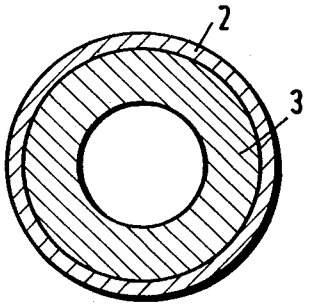
FIG. 3 is a transverse sectional view showing the tubular composite before it is pressed.

FIG. 3 shows a composite consisting of a copper tube 3 and a sheath 2 of the special steel tubing before the final shaping.

Figure 4:
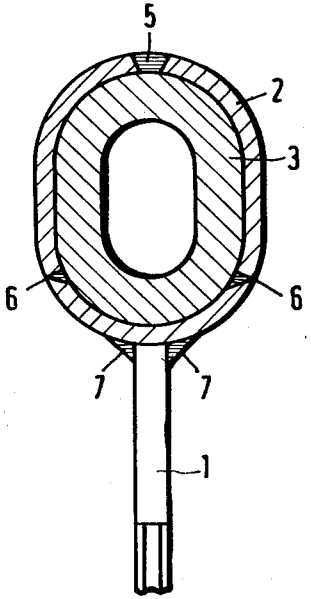
FIG. 4 is a transverse sectional view showing the deformed and welded composite provided with the cathode plate.

In FIG. 4, the oval carrying rail consisting of the composite tube and the cathode plate are shown in a sectional view after the shaping operation. The cathode plate 1 is joined by the seam weld 7 to the sheath 2. The welds 6 seal the joint between the copper section and the special steel sheath at the recess formed in the sheath and prevent a diffusion. A seam weld 5 seals a longitudinal slot in the top generatrix of the special steel section and ensures a flow of current from the current-carrying core section to the sheath section.

Figure 5:
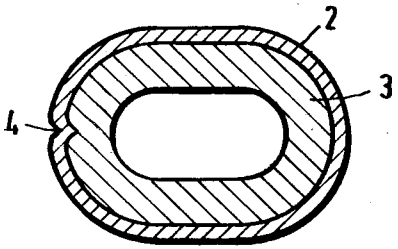
FIG. 5 is an enlarged transverse sectional view taken on line C–D in FIG. 2 and showing the composite after its non-cutting shaping.

FIG. 5 is a sectional view taken on line C–D in FIG. 2 and shows a large center punch mark 4, which acts on the sheath 2 and the inner hollow section 3 and provides an additional contact point.

Figure 6:
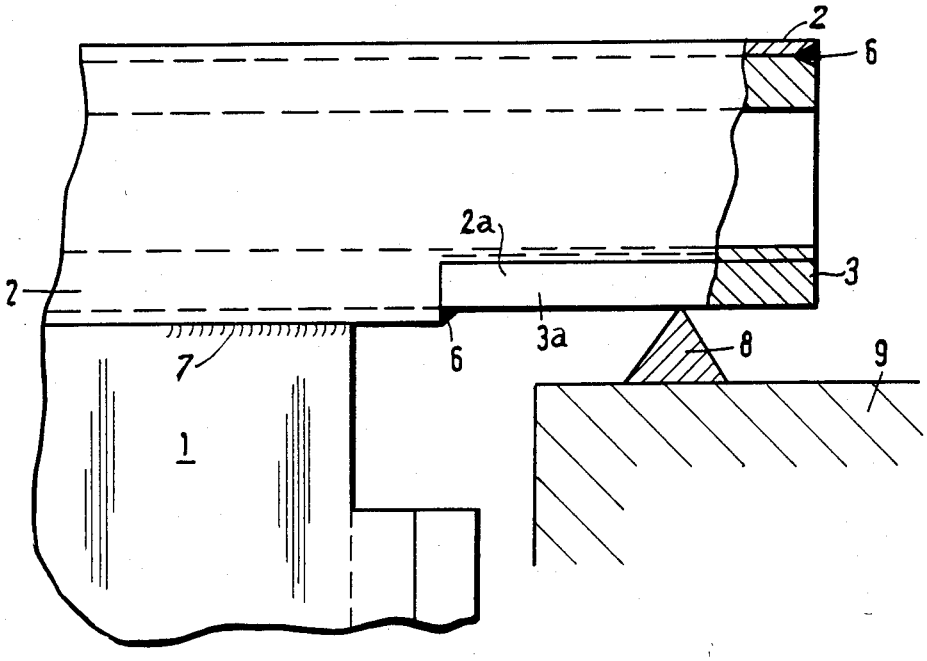
FIG. 6 is a side elevational showing the rail end portion of the mounting device provided with the cathode and shows the end of the carrying rail resting on the busbar of the electrolytic cell.

FIG. 6 is a side elevation showing the end portion of the mounting device. The composite consisting of the hollow copper section 3 and the special steel sheath 2 joined to the section 3 by welds 6 has an unsheathed portion 3*a* resting on the busbar 8 on the well 9 of the electrolytic cell.

Figure 7:
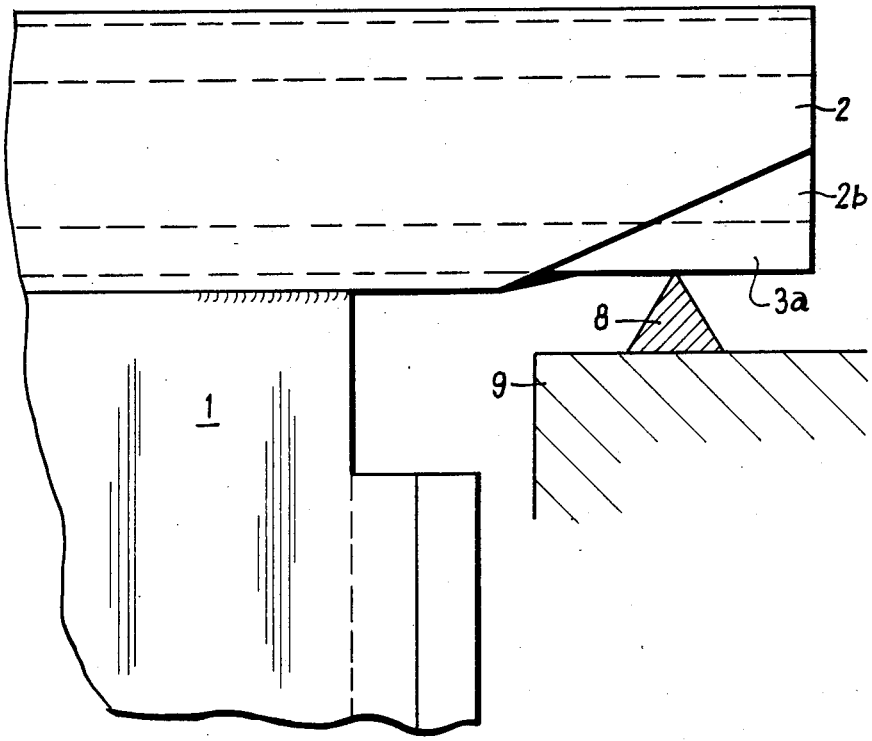
FIG. 7 is a side elevation like FIG. 6 and shows another form of the recess in the end portion of the sheath on the underside.

The view of FIG. 7 is similar to that of FIG. 6 but shows a sheath 2 formed at its end on the underside with a recess 2*b* which rises outwardly and toward the axis of the section.

It will be appreciated that the instant specification and claims are set forth by way of illustration and not limitation, and that various modifications and changes may be made without departing from the spirit and scope of the present invention.

What is claimed is:

1. In a current-feeding cathode-mounting device comprising a metal-sheathed carrying rail of copper and a permanent cathode plate joined by welding at least along part of a longitudinal edge of the plate, wherein at least an end portion of the rail is unsheathed at least along part of its extent, the improvement wherein the carrying rail comprises a hollow copper tube, the sheath comprises a tube of stainless steel which surrounds the copper tube as a snug fit and has a continuous longitudinal slot which is filled throughout its length with a weld bead to provide a more uniform flow of current, the sheath is joined to the carrying rail by a diffusion-preventing non-porous weld, and the permanent cathode comprises the same material as the sheath and is joined to the sheath by an interrupted seam weld.

2. The current-feeding cathode mounting device according to claim 1, wherein the copper tube and sheath are deformed to form a composite having one of an elliptical cross-section and oval cross-section, and a cross-section having two parallel sides, and the major axis of said cross-section lies in the plane of the cathode plate.

3. The current-feeding cathode-mounting device according to claim 2, further comprising pressure contact points including at least one of spot welds and center punch marks in the sheath adjacent to the seam weld for holding the cathode plate.

4. The current-feeding cathode-mounting device according to claim 1, wherein the stainless steel is composed of chromium and nickel or chromium, nickel and molybdenum.

* * * * *